US005449073A

United States Patent [19]

DeBeverly

[11] Patent Number: 5,449,073

[45] Date of Patent: Sep. 12, 1995

[54] JEWELRY CHAIN ORGANIZER/DISPLAY ASSEMBLY

[76] Inventor: Calvin J. DeBeverly, 3102 Wilma, Wichita, Kans. 67211

[21] Appl. No.: 178,017

[22] Filed: Jan. 6, 1994

[51] Int. Cl.[6] ..... A47F 7/00

[52] U.S. Cl. ..... 211/13; 211/168

[58] Field of Search ..... 211/13, 96, 168

[56] References Cited

U.S. PATENT DOCUMENTS

| | | | |
|---|---|---|---|
| 277,736 | 5/1883 | Iske | 211/96 X |
| 318,147 | 5/1885 | Stevens | 211/96 |
| 2,131,990 | 10/1938 | Tisdale | 211/96 |
| 2,485,201 | 10/1949 | Jewett | 211/96 |
| 3,380,594 | 4/1968 | MacCluney | 211/13 |
| 4,141,453 | 2/1979 | Hanan | 211/13 X |

FOREIGN PATENT DOCUMENTS

| | | | |
|---|---|---|---|
| 87003 | 4/1966 | France | 211/96 |

*Primary Examiner*—Ramon O. Ramirez
*Assistant Examiner*—Sarah L. Purol
*Attorney, Agent, or Firm*—Phillip A. Rein

[57] ABSTRACT

A jewelry chain organizer/display assembly having a primary support base assembly with an article support and display assembly connected thereto. The article support and display assembly includes a vertical support rod member having a plurality of pivotal horizontal display assemblies connected thereto to pivot about a vertical axis. The primary support base assembly is operable to be supported on a horizontal surface or to be mounted by wall support connectors to a vertical support wall. Each pivotal horizontal display assembly includes a hanger support hub member mounted about the vertical support rod member and having an article hanger rod member connected to respective ones of the hanger support hub members. Each article hanger rod member is movable about a vertical axis and having separate groove portions thereon to respectively receive and support a jewelry item thereon. The pivotal horizontal display assemblies are independently pivotal about a vertical axis being operable to hold a chain member or the like thereon in a vertically displayed condition and separated from each other.

10 Claims, 2 Drawing Sheets

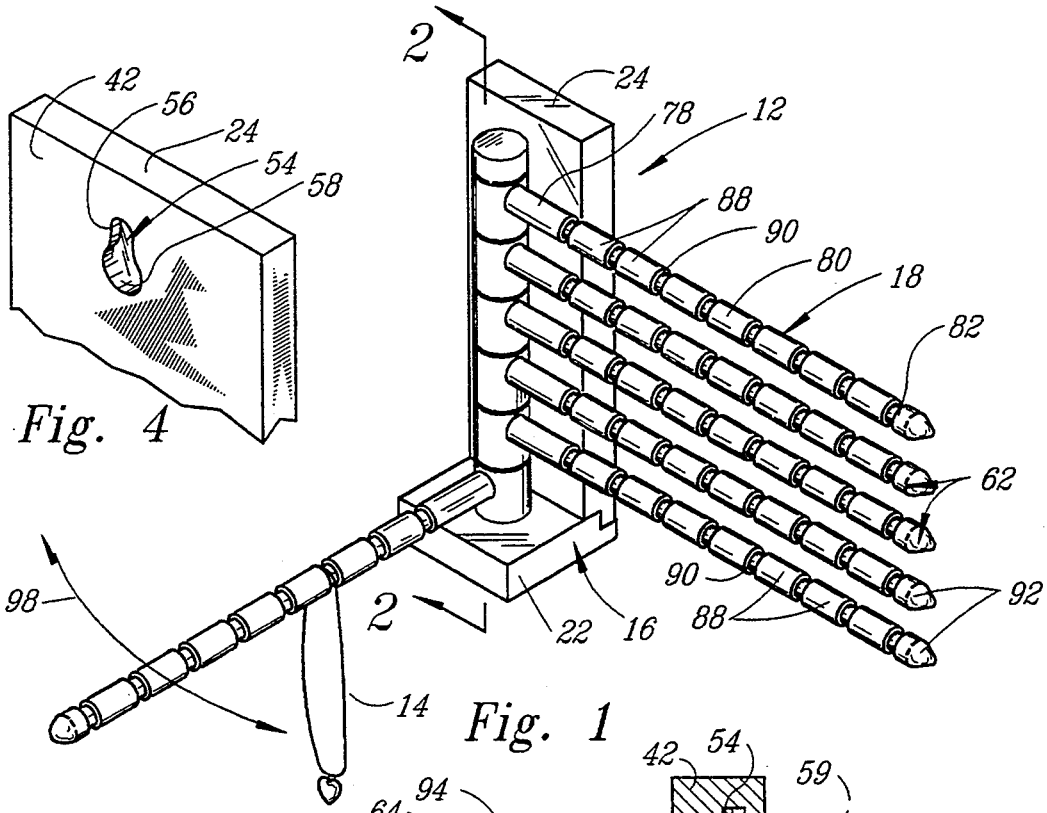
Fig. 1
Fig. 4
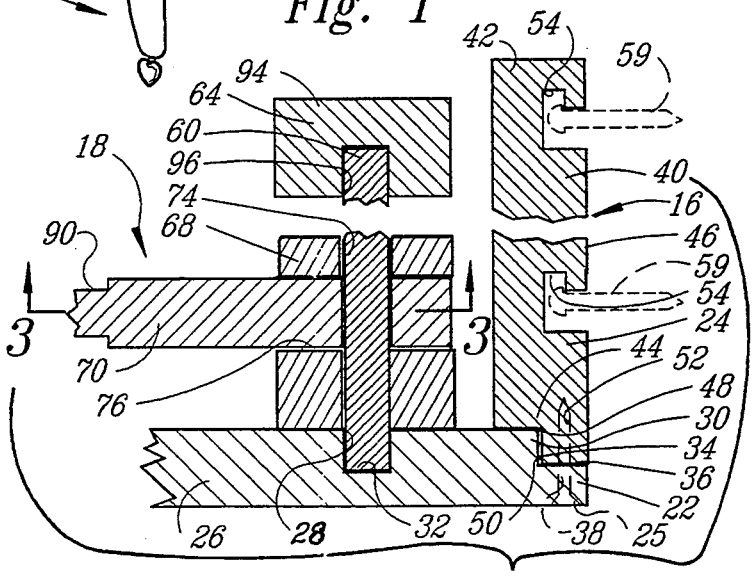
Fig. 2
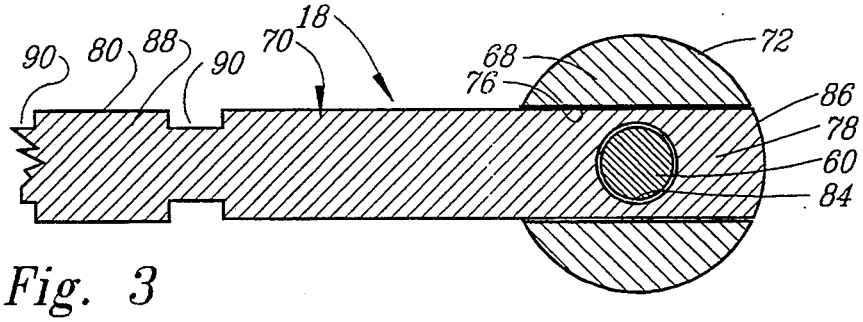
Fig. 3

JEWELRY CHAIN ORGANIZER/DISPLAY ASSEMBLY

PRIOR ART

A patent search revealed the following United States patents:

| Patent No. | Invention | Inventor |
|---|---|---|
| 128,323 | IMPROVEMENT IN CLOTHES DRIERS | Anson W. Phillips |
| 133,058 | IMPROVEMENT IN CLOTHES-RACKS | Henry W. Ross |
| 236,654 | WALL-PAPER EXHIBITOR | Francis Van Duzer |
| Des. 244,971 | STAND FOR POTTED PLANTS | Naumoff et al |
| Des. 245,131 | DISPLAY STAND | Berndt Johnsson |
| Des. 247,659 | SUPPORT FOR HANGING POTTED PLANTS | Linden P. Kearney |
| 2,650,717 | DISPLAY STAND | Charles O. Larson |
| 2,692,689 | DISPLAY RACK | Morgan Dozier Wynne, Sr. |
| 3,517,824 | SHEET STACK LEVELER FOR PRINTING PRESS | Francis H. Paque |
| 3,635,352 | SPACE SAVER DRAWING HOLDER | Brooks et al |
| 4,127,195 | CLOTHES DRYER RACK | Simon Portnoy |

The Phillip and Ross patents disclose clothes drier racks having a support hub mounted about a central support rod and having horizontally extended rod type support members thereon.

The Van Duzer patent discloses a wall-paper exhibitor.

The Naumoff et al and Johnsson patents disclose stands for display items and pivotal support assemblies to hold plants or other items thereon.

The Kearney patent discloses a support for hanging potted plants.

The Larson patent discloses a display stand to hold various hardware type articles therein and teaches the hanging of items on independently pivotal horizontally extended support rods.

The Wynne, Sr. patent discloses a display rack and used to support jewelry thereon.

The Paque patent discloses a sheet stack leveler for a printing press having independently pivotal blades.

The Brooks et al patent discloses a space saver drawing holder having support hubs with horizontal rods.

The Portnoy patent discloses a clothes dryer rack which teaches attachment to a vertical support wall.

PREFERRED EMBODIMENT OF THE INVENTION

In one preferred embodiment of this invention, a jewelry chain organizer/display assembly is operable to be supported on a horizontal support surface or mounted against a vertical wall and having means thereon to support and display necklaces, chain members, and other similar articles.

The jewelry chain organizer/display assembly includes a primary support base assembly having an article support and display assembly connected thereto.

The primary support base assembly includes a support base member having a vertical support base member secured thereto as by connector members.

The vertical support base member includes a support body section having therein a vertical support rod hole and a stepped rear section along a side wall portion thereof to be connected to the vertical support base member. The vertical support rod hole is provided with an end wall section and is operable to receive and support a rod member therein as will be noted.

The stepped rear section is formed with a vertical wall portion and a horizontal wall portion having anchor holes therein for assembly purposes.

The vertical support base member includes 1) a main support body having a top wall section; 2) a stepped bottom wall section; and 3) a back wall surface. The stepped bottom wall section is provided with a vertical wall section and a horizontal wall section which is adapted to nest and be attached to the stepped rear section of the support base member.

The horizontal wall section is provided with a pair of spaced anchor holes to receive the connector members therein when being attached to the support base member.

The back wall surface is formed with a pair of spaced key hole mounting slots, each having an upper arcuate anchor portion integral with a lower connector entrance portion.

In the assembled condition, the connector members may be screw members which are secured in the anchor holes in the stepped rear section and into the anchor openings in the stepped bottom wall section in the vertical support base member and tightened to form a rigid interconnection between the support base member and the vertical support base member.

The key hole mounting slots are operable in a conventional manner to receive a wall support connector therein when mounting against a vertical wall surface.

The article support and display assembly includes 1) a vertical support rod member having one end mounted in the support rod hole in the support base member of the primary support base assembly; 2) a plurality of pivotal horizontal display assemblies telescopingly mounted about the vertical support rod member; and 3) an enclosure cap member mounted about an upper end of the vertical support rod member to hold the pivotal horizontal display assemblies thereon.

The vertical support rod member has a lower connector section mounted in the vertical support rod hole and an upper connector section having the enclosure cap member mounted thereon.

As each pivotal horizontal display assembly is of an identical structure, only one need be described in detail. The pivotal horizontal display assembly includes a hanger support hub member with an article hanger rod member connected thereto.

The hanger support hub member has a cylindrical body section provided with a central vertical support rod hole and a horizontal hanger rod hole.

The article hanger rod member is provided with a connector end section connected to the hanger support hub member and integral with an intermediate central section which, in turn, is integral with an outer end cap section.

The connector end section is provided with a rod connector hole to receive the vertical support rod member therethrough and an outer arcuate end wall section having a curvature so as to be contoured similar to the outer support surface of the hanger support hub member.

The intermediate central section is provided with a plurality of spaced hub segment portions, each having separator groove portions mounted therebetween. The separator groove portions are operable to receive and retain the necklaces and chain members therein as will be explained.

The outer end cap section is provided with a cone shaped end portion for ease of grasping and pivoting the respective article hanger rod member and provides an attractive appearance.

The enclosure cap member has an outer cap body section and a rod enclosure opening. The rod enclosure opening is adapted to receive the upper connector section of the vertical support rod member therein. An outer cylinder surface of the cap body section is of the same diameter as the hanger support hub member to achieve an overall attractive appearance.

In the assembled condition of FIG. 1, it is noted that each of the pivotal horizontal display assemblies can be independently pivoted to reveal the various necklaces or chain members mounted thereon. It is possible to mount eight such necklaces or chain members on each article hanger rod member within the confines of the separator groove portions.

Additionally, the jewelry chain organizer/display assembly can be utilized with wall support connectors mounted within the key hole mounting slots to be supported against a vertical wall which is the preferred method of usage of this invention.

OBJECTS OF THE INVENTION

One object of this invention is to provide a jewelry chain organizer/display assembly operable to be supported either on a horizontal support surface or mounted against a vertical wall and having means to receive, vertically support, and separate a plurality of necklaces or chain members thereon.

Another object of this invention is to provide a jewelry chain organizer/display assembly which includes a plurality of pivotal horizontal display assemblies having means thereon to receive, support, and separate a plurality of jewelry items thereon and each horizontal display assembly is independently pivotal about a vertical axis so as to not interfere with other necklace or chain members attached to adjacent ones of the horizontal display assemblies.

One other object of this invention is to provide a jewelry chain organizer/display assembly having a primary support base assembly of generally L-shape and having mounted thereon a plurality of stacked article support and display assemblies, each having a pivotal horizontal display assembly being independently pivotal and operable to receive, support, and separate a plurality of necklace or chain members thereon.

Still, one other object of this invention is to provide a jewelry chain organizer/display assembly which is operable to receive, support, and separate a plurality of necklace and chain members thereon which is easy to use; having the necklace and chain members easy to locate, retrieve, use, and return to storage; plus being economical to manufacture, sturdy in construction, and substantially maintenance free.

Various other objects, advantages, and features of the invention will become apparent to those skilled in the art from the following discussion, taken in conjunction with the accompanying drawings, in which:

FIGURES OF THE INVENTION

FIG. 1 is a perspective view of the jewelry chain organizer/display assembly of this invention;

FIG. 2 is an enlarged fragmentary foreshortened view taken along line 2—2 in FIG. 1;

FIG. 3 is an enlarged sectional view taken along line 3—3 in FIG. 2;

FIG. 4 is a fragmentary perspective view of an upper portion of a vertical support base member of the jewelry chain organizer/display assembly of this invention.

Figure 5:
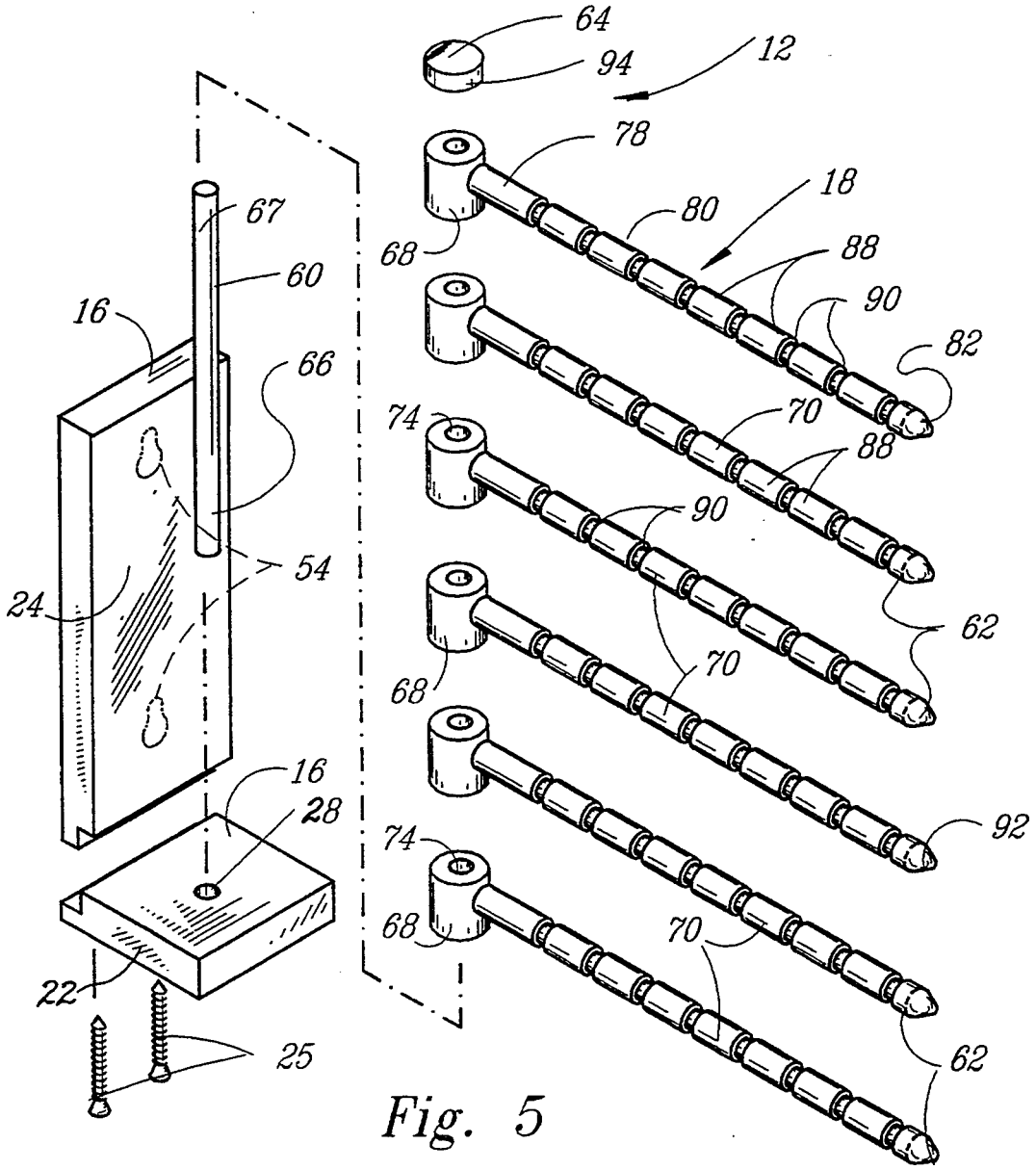
FIG. 5 is an exploded perspective view illustrating an assembly process of the jewelry chain organizer/display assembly of this invention.

The following is a discussion and description of preferred specific embodiments of the jewelry chain organizer/display assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a jewelry chain organizer/display assembly of this invention, indicated generally at 12, is operable to receive and hold a plurality of jewelry items such as necklaces or chain members 14 thereon. In this embodiment, it is noted that there are six separate jewelry support rods, each capable of supporting and separating eight chain members 14 thereon as will be noted.

The jewelry chain organizer/display assembly 12 includes a primary support base assembly 16 having a plurality of article support and display assemblies 18 mounted thereon in an adjacent vertical alignment relationship to each other.

The primary support base assembly 16 includes a support base member 22 having a vertical support base member 24 connected thereto by connector members 25. The support base member 22 has a support body section 26 having a vertical support rod hole 28 and a stepped rear section 30.

The vertical support rod hole 28 has an end wall section 32 to receive a portion of the article support and display assembly 18 therein as will be explained.

The stepped rear section 30 has a vertical wall portion 34 and a horizontal wall portion 36 having a pair of spaced anchor holes 38 therein. The stepped rear section 30 will add stability to the vertical support base member 24 when attached thereto by the connector members 25 as will be noted.

The vertical support base member 24 has a main support body 40 with a top wall section 42, a stepped bottom wall section 44, and a back wall surface 46.

The stepped bottom wall section 44 has a vertical wall section 48 and a horizontal wall section 50 adapted to nest within the stepped rear section 30 of the support base member 22 as noted in FIG. 2.

The horizontal wall section 50 has openings 52 therein operable to receive the connector members 25 therein as noted in FIG. 2.

The back wall surface 46 has a pair of vertically spaced key hole mounting slots 54 therein. Each key hole slot 54 is formed with an upper arcuate anchor portion 56 integral with a lower connector entrance portion 58 to place screw members or wall support connector members 59 therein in a conventional manner on anchoring to a vertical wall.

The article support and display assembly 18 includes 1) a vertical support rod member 60 mounted within the vertical support rod hole 28 in the support base member 22; 2) a plurality of pivotal horizontal display assemblies 62 which are mounted on and stacked on the vertical support rod member 60; and 3) an enclosure cap member 64 mounted about an upper end of the vertical support rod member 60.

The vertical support rod member 60 is provided with a lower connector section 66 which is mounted within the vertical support rod hole 28 in the support base member 22 and an upper connector section 67 to receive the enclosure cap member 64 thereon.

As each pivotal horizontal display assembly 62 is identical, only one need be described in detail. Each pivotal display assembly 62 includes 1) a hanger support hub member 68; and 2) an article hanger rod member 70 having one end connected to the hanger support hub member 68.

The hanger support hub member 68 has a cylindrical body section 72 provided with a vertical support rod hole 74 and a horizontal anchor rod hole 76 which intersects the vertical support rod hole 74 at 90 degrees to each other.

It is to be noted that the diameter of the support rod hole 74 is slightly larger than the diameter of the vertical support rod member 60 to allow pivotal movement of the respective pivotal horizontal display assemblies 62 about the vertical support rod member 60.

The article hanger rod member 70 is securely mounted in the horizontal hanger rod hole 76 so that the interconnected hanger support hub member 68 and the article hanger rod member 70 rotate and pivot conjointly as a sturdy unit about the vertical support rod member 60. These elements are assembled in relative sizes so that there is no bending downwardly of the article hanger rod member 70 when loaded up with a plurality, namely eight, necklace or chain members 14.

As noted in FIG. 5, each article hanger rod member 70 is 1) provided with a connector end section 78 to be mounted within respective ones of the horizontal hanger rod holes 76; and 2) an intermediate central section 80 integral with the connector end section 78 and, in turn, integral with an outer end cap section 82.

The connector end section 78 is provided with a vertical rod connector hole 84 and an arcuate end wall section 86. The vertical rod connector hole 84 is nearly the same diameter as the vertical support rod member 60 so that there is no tipping of the article hanger rod member 70 under a load of the necklace and/or chain members 14.

The arcuate end wall section 86 is of a contour so as to blend in with the arcuate surfaces of the cylindrical body section 72 of the hanger support hub member 68.

The intermediate central section 80 is provided with a plurality of spaced hub segment portions 88 and having therebetween separator groove portions 90. The separator groove portions 90 are of a smaller diameter than the hub segment portions 88 in order to provide means thereon for receiving a portion of a chain member 14 therein to keep it from sliding or moving along a longitudinal axis of the article hanger rod member 70.

Additionally, the use of the hub segment portions 88 are to prevent the interaction or contact between the chain members 14 to prevent scratching or damaging and allows for any of the chain members 14 to be easily lifted upwardly of the separator groove portions 90 and then outwardly therefrom for use of a selected chain member 14.

Further, the separator groove portions 90 allow the reverse process for replacing the chain member 14 in a desired separator groove portion 90.

The outer end cap section 82 is provided with a cone shaped end portion 92 which provides an attractive feature and can be grasped by one utilizing the jewelry chain organizer/display assembly 12 for pivotal movement as noted by an arrow 98 in FIG. 1.

As noted in FIG. 2, the enclosure cap member 64 is provided with a cap body section 94 and having a rod enclosure opening 96. The cap body section 94 is of a similar diameter as the hanger support hub member 68 so as to achieve an attractive appearance in the assembled condition as noted in FIG. 1.

The rod enclosure opening 96 is of a size to fit snugly on the upper connector section 67 of the vertical support rod member 60 when in the assembled condition.

USE AND OPERATION OF THE INVENTION

In order to understand the assembly method of the jewelry chain organizer/display assembly 12 of this invention, refer to FIG. 5 whereupon the first element would be to produce the primary support base assembly 16, namely, the support base member 22 and vertical support base member 24 with the respective stepped rear section 30 and stepped bottom wall section 44 which are to be placed in abutting relationship. The vertical support rod hole 28 has been bored into the top surface of the support body section 26.

The support base member 22 is thereupon secured to the vertical support base member 24 through the use of connector members or screw members 25 to be placed within the anchor holes 38 and anchor opening 52 in the assembled condition of the connector members 25 as noted in FIG. 2.

Before the assembly, it is obvious that the key hole mounting slots 54 are cut into the back wall surface 46 of the vertical support base member 24 as noted in dotted lines in FIG. 5.

The next step would be to place the lower connector section 66 of the vertical support rod member 60 within the vertical support rod hole 28 and against the end wall section 32. The support rod member 60 would be anchored therein with use of adhesive or the like and would be very tight fitting to provide a rigid vertical support for the pivotal horizontal display assemblies 62.

Next, respective ones of the pivotal horizontal display assemblies 62 are placed with the vertical support rod holes 74 about the vertical support rod member 60 in a stacked relationship as noted in FIG. 1. Finally, the enclosure cap member 64 has the rod enclosure opening 96 which is placed about the upper connector section 67 of the vertical support rod member 60.

It would be a close fit between the upper connector section 67 and the rod enclosure opening 96 and, of course, an adhesive could be used to secure the same thereto so that the pivotal horizontal display assemblies 62 would not become dislodged therefrom.

As noted in the assembled condition of the jewelry chain organizer/display assembly 12 in FIG. 5, the interconnections between the various holes are close fitting and rigid, namely, between the vertical support rod member 60 and the vertical support rod holes 74 so that the outer ends of the article hanger rod member 70 would not tend to move downwardly when loaded up with a plurality of the chain members 14 thereon.

This close fitting is further controlled by the interconnection of the vertical support rod members 60 and the vertical rod connector hole 84 and the connector end section 78 of the article hanger rod member 70.

In the use of the jewelry chain organizer/display assembly 12, it is obvious that it could be placed on a horizontal surface having the support base member 22 with its lower surface providing the main support. However, in this type of mounting, it would have to be placed next to the edge of a dresser so that the chain members 14 could hang below the lower surface of the support base member 22.

Additionally, when utilizing this horizontal surface mounting feature, one must be careful that all of the pivotal horizontal display assemblies 62 are not pointed in the same direction which would tip over the primary support base assembly 16 unless the support base member 22 was secured as by screws or the like to a support surface to prevent this tipping thereof due to the weight of the chain members 14.

A preferred method of mounting would be against a vertical wall surface as by the wall support connectors 59 which are to be placed within respective ones of the key hole mounting slots 54 as noted in FIG. 2. It is obvious that head portions of the wall support connectors 59 are first mounted through the lower support connector portion 58. When both are placed in this condition, the primary support base assembly 16 is moved downwardly so as to interlock a head portion of the wall support connectors 59 within the upper arcuate anchor portion 56 in a conventional manner.

When mounting on a vertical wall, it is obvious that substantial support is given thereto and the various ones of the article hanger rod members 70 and their interconnected hanger support hub members 68 could be pivoted outwardly substantially in a 180 degree arch as noted by an arrow 98 in FIG. 1. This is the most satisfactory way of mounting utilizing the jewelry chain organizer/display assembly 12 as the chain members 14 would have plenty of vertical space for movement downwardly and, due to the rigid mounting to a vertical wall, this would not tend to tip over the primary support base assembly 16 due to the weight of the chain members 14. This would hold the chain members 14 in an attractive, vertical position with each article hanger rod member 70 being individually pivotal outwardly and each having eight separator groove portions 90 for storing respective ones of the chain members 14 thereon.

The length of the hub segment portions 88 are such so as to provide for substantial separation of the hanging chain members 14 and prevent them from moving axially on respective ones of the article hanger rod members 70 to prevent their comingling, becoming tangled, damaged, and the like.

The jewelry chain organizer/display assembly of this invention is easy to manufacture and assemble; rigid in construction; economical to manufacture; attractive in appearance; easy to use; operable to hold a plurality of chain members in a vertically attractively displayed condition, positively separated from other adjacent chain members; and substantially maintenance free.

While the invention has been described in conjunction with preferred specific embodiments thereof, it will be understood that this description is intended to illustrate and not to limit the scope of the invention, which is defined by the following claims:

I claim:

1. A jewelry chain organizer/display assembly operable to receive, support, and display jewelry items thereon, comprising:

a) a support base assembly;

b) an article support and display assembly connected to said support base assembly;

c) said article support and display assembly includes a support rod member connected to said support base assembly and a display assembly pivotally connected to said support rod member;

d) said display assembly includes a hanger support hub member pivotally mounted on said support rod member and an article hanger rod member connected to, and extended laterally from, said hanger support hub member;

e) said article hanger rod member having a plurality of spaced separator groove portions, each operable to receive a single one of the jewelry items thereon for support and display f) said article hanger rod member having a plurality of spaced hub segment portions separated by said separator groove portions operable to receive and retain the jewelry items thereof and prevent lateral movement thereof on said article hanger rod member; and g) said hub segment portions and said separator groove portions of circular shape in transverse cross section with said separator groove portions of a diameter less than said hub segment portions.

2. A jewelry chain organizer/display assembly as described in claim 1, including:

a) an enclosure cap member having a rod enclosure opening to be placed about an upper end of said support rod member and being of a diameter identical to a diameter of said hanger support hub member to present an attractive appearing jewelry item support structure.

3. A jewelry chain organizer/display assembly operable to receive, support, and display jewelry items thereon, comprising:

a) a support base assembly;

b) an article support and display assembly including a vertical support rod member connected to said support base assembly and a plurality of horizontal display assemblies connected to said vertical support rod member;

c) each of said horizontal display assemblies include a hanger support hub member rotatably connected to said vertical support rod member and an article hanger rod member connected to said hanger support hub member extended laterally and horizontally therefrom; and d) said article hanger rod member having a plurality of hub segment portions of circular shape in transverse cross section separated by separator groove portions of a diameter less than said hub segment portions;

whereby said separator groove portions are operable to receive jewelry items such as necklaces and chains thereon for support, separation, and display.

4. A jewelry chain organizer/display assembly as described in claim 3, wherein:

a) each of said hanger support hub members having a vertical support rod hole to receive said support rod member therein and a horizontal hanger hole extended perpendicular to said vertical support rod hole to receive one end of said article hanger rod member therein to hold in a rigid horizontal position with a plurality of the jewelry items mounted in said separator groove portions b) said vertical support rod hole and said support rod member of generally identical diameter but allowing pivotal movement of respective ones of said horizontal display assemblies so that said article hanger rod member is not deflected downwardly on having a plurality of the jewelry items mounted thereon; and c) said hanger support hub members in frictional contact with adjacent ones of said hanger support hub members to hold each respective one of said horizontal display assemblies in a selected rotational position about said vertical support rod member.

5. A jewelry chain organizer/display assembly as described in claim 3, including:

a) an enclosure cap member having a cap body section of identical diameter to said hanger support hub members and a rod enclosure opening mounted about an upper end of said support rod member to achieve an overall attractive appearance.

6. A jewelry chain organizer/display assembly operable to receive, support, separate, and display jewelry necklace items thereon, comprising:

a) a support base assembly;

b) an article support and display assembly connected to said support base assembly;

c) said article support and display assembly includes a support rod member connected to said support base assembly and a display assembly pivotally connected to said support rod member;

d) said display assembly includes a hanger support hub member pivotally mounted on said support rod member and an article hanger rod member connected to, and extended laterally from, said hanger support hub member;

e) said article hanger rod member having a plurality of spaced separator groove portions of a width to receive, support, and separate a single jewelry necklace item;

f) said article hanger rod member having a plurality of spaced hub segment portions separated by said separator groove portions; and g) said hub segment portion of a width substantially greater than said width of said separator groove portions;

whereby the single jewelry necklace items mounted in adjacent ones of said separator groove portion are sufficiently separated by adjacent ones of said hub segment portions to avoid contact and resultant damage to adjacent ones of the single jewelry necklace items.

7. A jewelry chain organizer/display assembly as described in claim 6, wherein:

a) said separator groove portions and said hub segment portions both of circular shape in transverse cross section.

8. A jewelry chain organizer/display assembly as described in claim 7, wherein:

a) said hub segment portions of a diameter greater than said separator groove portions and extends laterally thereabout.

9. A jewelry chain organizer/display assembly as described in claim 6, wherein:

a) said article support and display assembly including said vertical support rod member connected to said support base assembly and a plurality of said horizontal display assemblies connected to said vertical support rod member.

10. A jewelry chain organizer/display assembly as described in claim 9, including:

a) an enclosure cap member having a rod enclosure opening to be placed about an upper end of said support rod member and being of a diameter identical to a diameter of said hanger support hub member to present an attractive appearing jewelry item support structure.

* * * * *